US011066963B2

(12) United States Patent
Okamoto

(10) Patent No.: US 11,066,963 B2
(45) Date of Patent: Jul. 20, 2021

(54) INTERNAL COMBUSTION ENGINE AND VEHICLE

(71) Applicant: YAMAHA HATSUDOKI KABUSHIKI KAISHA, Iwata (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 12 days.

(21) Appl. No.: 16/621,715

(22) PCT Filed: Apr. 27, 2018

(86) PCT No.: PCT/JP2018/017284

§ 371 (c)(1),
(2) Date: Dec. 12, 2019

(87) PCT Pub. No.: WO2019/003630

PCT Pub. Date: Jan. 3, 2019

(65) Prior Publication Data

US 2021/0140348 A1 May 13, 2021

(30) Foreign Application Priority Data

Jun. 30, 2017 (JP) ..... JP2017-128792

(51) Int. Cl.
*F01L 1/18* (2006.01)
*F01L 1/053* (2006.01)
(Continued)

(52) U.S. Cl.
CPC ..... *F01L 1/181* (2013.01); *F01L 1/053* (2013.01); *F01L 1/462* (2013.01); *F02F 1/24* (2013.01); *F01L 2001/467* (2013.01)

(58) Field of Classification Search
CPC . F01L 1/181; F01L 1/462; F01L 1/053; F01L 2001/467; F02F 1/24
See application file for complete search history.

(56) References Cited

U.S. PATENT DOCUMENTS 1,815,612 A 7/1931 Cataline et al.
4,615,307 A * 10/1986 Kodama ..... F01L 13/0005 123/90.16
4,787,346 A * 11/1988 Ajiki ..... F01L 1/185 123/90.16

FOREIGN PATENT DOCUMENTS

DE 44 10 288 C1 6/1995
GB 2 185 784 A 7/1987
(Continued)

OTHER PUBLICATIONS

Official Communication issued in International Patent Application No. PCT/JP2018/017284, dated Jul. 10, 2018.

*Primary Examiner* — Zelalem Eshete
(74) *Attorney, Agent, or Firm* — Keating and Bennett, LLP

(57) ABSTRACT

An internal combustion engine includes, as a lost motion spring that urges a rocker arm toward a cam, a compression coil spring supported on a cylinder head. A shaft is located on an inner side of the compression coil spring and extends along a winding axis of the compression coil spring. The internal combustion engine significantly reduces or prevents a decrease in the fuel efficiency and an increase in the size of the variable valve mechanism, while surging is unlikely to occur while running at a high speed, and it is possible to reduce the size or the weight of the rocker arm.

9 Claims, 9 Drawing Sheets

(51) Int. Cl.
*F01L 1/46* (2006.01)
*F02F 1/24* (2006.01)

(56) References Cited

FOREIGN PATENT DOCUMENTS

| | | | |
|---|---|---|---|
| GB | 2 269 856 | A | 2/1994 |
| JP | 10-18826 | A | 1/1998 |
| JP | 2003-001361 | A | 1/2003 |
| JP | 2009-185753 | A | 8/2009 |
| JP | 2011-202577 | A | 10/2011 |
| JP | 2016-094901 | A | 5/2016 |

* cited by examiner

INTERNAL COMBUSTION ENGINE AND VEHICLE

BACKGROUND OF THE INVENTION

1. Field of the Invention

The present invention relates to an internal combustion engine and a vehicle.

2. Description of the Related Art

There are conventional internal combustion engines that have a variable valve mechanism wherein the valve operation state can be switched, as disclosed in Japanese Laid-Open Patent Publication No. 2009-185753, for example. A variable valve mechanism has a rocker arm including a first arm pivotally supported on a cylinder head and a second arm pivotally supported on the first arm, and a connecting mechanism that removably connects the first arm and the second arm. The first arm includes an abutting portion that abuts the valve. The second arm includes a contact portion that contacts with a cam provided on a cam shaft. When the first arm and the second arm are connected by the connecting mechanism, the second arm pivots as a single unit together with the first arm. Therefore, when the cam presses the contact portion of the second arm, the first arm and the second arm pivot as a single unit, and the abutting portion of the first arm presses the valve, thus opening the valve. On the other hand, when the first arm and the second arm are not connected by the connecting mechanism, the second arm pivots relative to the first arm. When the cam presses the contact portion of the second arm, the abutting portion of the first arm presses the valve after the second arm pivots, thus opening the valve with a delay. Alternatively, when the cam presses the contact portion of the second arm, the second arm pivots but the first arm does not pivot, and the valve remains closed. With the variable valve mechanism, it is possible to switch the operation state of the valve as described above.

The variable valve mechanism also includes a lost motion spring that urges the second arm toward the cam. The variable valve mechanism of the internal combustion engine disclosed in Japanese Laid-Open Patent Publication No. 2009-185753 includes, as a lost motion spring, a torsion coil spring attached to the first arm and the second arm.

When a torsion coil spring is used as a lost motion spring, the first arm and the second arm of the rocker arm each need to be provided with an attachment portion where the torsion coil spring is attached. This increases the size and the weight of the rocker arm. In view of this, one may consider using a compression coil spring, as a lost motion spring, separate from the rocker arm, instead of a torsion coil spring attached to the rocker arm.

However, the variable valve mechanism includes a valve, a valve spring, a valve spring retainer, etc., in addition to the cam and the rocker arm. Where a compression coil spring is installed, the space for installation is often limited. When a compression coil spring is used, a winding diameter of the compression coil spring needs to be kept small so as not to interfere with other members. However, the compression coil spring needs to output an intended force. When the winding diameter is kept small, there is a need to ensure a sufficient length. Therefore, there is a need to use, as a lost motion spring, a compression coil spring that is thin and long.

However, a compression coil spring that is thin and long is likely to bend relative to the winding axis upon expansion/contraction. Therefore, an intended force cannot be output stably, and the operation of the second arm becomes unstable, thus changing the operating speed of the connecting mechanism, and shifting the timing with which to open/close the valve. As a result, it may narrow the switchable range of the valve operation state, thus lowering the fuel efficiency of the internal combustion engine. If the compression coil spring bends relative to the winding axis upon expansion/contraction, it may come into contact with other members. There is a need to provide a sufficient clearance with other members in order to avoid such contact, which may lead to an increase in the size of the variable valve mechanism. Moreover, a compression coil spring that is thin and long is likely to cause surging while the internal combustion engine is running at a high speed.

SUMMARY OF THE INVENTION

Preferred embodiments of the present invention provide internal combustion engines with which it is possible to significantly reduce or prevent a decrease in the fuel efficiency and an increase in the size of a variable valve mechanism, while surging is unlikely to occur while running at a high speed, and it is possible to reduce the size or the weight of a rocker arm, and a vehicle including the same.

An internal combustion engine according to a preferred embodiment of the present invention includes a cylinder head; a port in the cylinder head; a valve in the cylinder head that opens/closes the port; a cam shaft rotatably supported on the cylinder head; a cam provided on the cam shaft; a compression coil spring supported on the cylinder head; and a rocker arm. The rocker arm includes a first arm and a second arm, wherein the first arm includes a supported portion pivotally supported on the cylinder head and an abutting portion that abuts on the valve, and the second arm includes a contact portion that contacts with the cam and a spring force receiver that receives a force of the compression coil spring, and the second arm is pivotally supported on the first arm. The internal combustion engine further includes a connector that removably connects the first arm and the second arm; and a shaft that is located on an inner side of the compression coil spring and extends along a winding axis of the compression coil spring.

The internal combustion engine described above includes, as a lost motion spring, a compression coil spring separate from the rocker arm. Since there is no need to attach a torsion coil spring to the rocker arm, it is possible to reduce the size and the weight of the rocker arm. Since the shaft that is located on the inner side of the compression coil spring restricts bending of the compression coil spring, the compression coil spring is unlikely to bend relative to the winding axis. Therefore, the compression coil spring outputs an intended force in a stable manner, and the timing with which to open/close the valve is unlikely to shift. Thus, the switchable range of the valve operation state will not be narrowed, thus significantly reducing or preventing a decrease in the fuel efficiency. Since the compression coil spring is unlikely to bend relative to the winding axis, the compression coil spring is unlikely to interfere with other members in the vicinity thereof. Therefore, there is no need to increase the clearance between the compression coil spring and other members in the vicinity thereof, and it is possible to significantly reduce or prevent an increase in the size of the variable valve mechanism. Moreover, the compression coil spring is able to come into contact with the shaft, and when surging is about to occur while the internal combustion engine is running at a high speed, the compression coil spring and the shaft come into contact with each other, thus attenuating the surging. Thus, surging is unlikely to occur while running at a high speed.

According to a preferred embodiment of the present invention, the shaft includes a first shaft end portion, and a second shaft end portion that is located on a side of the second arm relative to the first shaft end portion. The internal combustion engine further includes a spring seat that is provided at the first shaft end portion of the shaft and receives the compression coil spring.

According to the preferred embodiment described above, the installment of the compression coil spring in the cylinder head is easy. Since the spring seat is installed together with the shaft, it is possible to prevent the installment of the spring seat from being forgotten.

According to a preferred embodiment of the present invention, the compression coil spring includes a first end portion, and a second end portion that is located on a side of the second arm relative to the first end portion. The internal combustion engine further includes a retainer including a top plate portion and a tube portion, wherein the top plate portion is supported on the second end portion of the compression coil spring and contacts with the spring force receiver of the second arm, and the tube portion extends from the top plate portion toward the compression coil spring along an axial direction of the shaft.

According to the preferred embodiment described above, it is possible with the tube portion of the retainer to further restrict bending of the compression coil spring. Thus, the compression coil spring outputs an intended force in a stable manner.

According to a preferred embodiment of the present invention, when the first arm and the second arm are connected together by the connector and the valve is closed, a portion of the tube portion of the retainer is located on a side of the second shaft end portion relative to the first shaft end portion and on a side of the first shaft end portion relative to the second shaft end portion.

According to the preferred embodiment described above, the tube portion of the retainer is elongated. A portion of the compression coil spring is located radially outward of the shaft and is located radially inward of the tube portion of the retainer. Therefore, it is possible to further restrict bending of the compression coil spring.

According to a preferred embodiment of the present invention, the cylinder head includes a hole; and at least a portion of the compression coil spring, at least a portion of the shaft, and at least a portion of the retainer are located inside the hole.

According to the preferred embodiment described above, the compression coil spring, the shaft, and the retainer are securely installed in the cylinder head. It is possible with the inner circumferential surface of the hole to further restrict bending of the compression coil spring.

According to a preferred embodiment of the present invention, a through opening is provided in the top plate portion.

When at least a portion of the compression coil spring, at least a portion of the shaft, and at least a portion of the retainer are located inside the hole, the movement of the retainer may possibly be hindered by the fluctuation of the air pressure inside the hole. However, according to the preferred embodiment described above, the air can move between the inside and the outside of the hole through the through hole in the top plate portion of the retainer. This reduces the fluctuation of the air pressure inside the hole, thus smoothing the movement of the retainer.

According to a preferred embodiment of the present invention, the cylinder head includes a hole; and at least a portion of the compression coil spring and at least a portion of the shaft are located inside the hole.

According to the preferred embodiment described above, the compression coil spring and the shaft are securely installed in the cylinder head. It is possible with the inner circumferential surface of the hole to further restrict bending of the compression coil spring.

According to a preferred embodiment of the present invention, the compression coil spring has a constant pitch.

A compression coil spring having a constant pitch is able to be made shorter than a compression coil spring with a pitch that is not constant. This provides a compact configuration. However, with a compression coil spring having a constant pitch, surging is more likely to occur, as compared with a compression coil spring with a pitch that is not constant. However, according to the preferred embodiment described above, it is possible to significantly reduce or prevent the surging of the compression coil spring due to the contact between the compression coil spring and the shaft. According to the preferred embodiment described above, the compression coil spring having a constant pitch, which contributes to providing a compact configuration, is used with no problems.

According to a preferred embodiment of the present invention, the internal combustion engine includes a valve spring retainer secured to the valve; and a valve spring, which defines a second compression coil spring, that includes a first spring end portion supported on the cylinder head and a second spring end portion supported on the valve spring retainer. A winding diameter of the compression coil spring is smaller than a winding diameter of the valve spring.

According to the preferred embodiment described above, the winding diameter of the compression coil spring is relatively small. Therefore, it is possible to easily avoid interference between the compression coil spring and other members in the vicinity thereof.

According to a preferred embodiment of the present invention, the valve spring includes a non-constant pitch section in which a pitch of the valve spring is not constant and a constant pitch section in which the pitch of the valve spring is constant, the non-constant pitch section extending from the first spring end portion toward the second spring end portion, and the constant pitch section extending from the non-constant pitch section toward the second spring end portion. When the first arm and the second arm are connected together by the connector and the valve is closed, a portion of the compression coil spring is located on a side of the non-constant pitch section relative to the constant pitch section, and another portion of the compression coil spring is located on a side of the constant pitch section relative to the non-constant pitch section.

According to the preferred embodiment described above, the compression coil spring extends from the constant pitch section to the non-constant pitch section of the valve spring in the winding direction of the valve spring. The compression coil spring is relatively long. Thus, the compression coil spring outputs an intended force in a stable manner even if the winding diameter is small.

A vehicle according to a preferred embodiment of the present invention includes the internal combustion engine described above.

Thus, it is possible to obtain a vehicle that realizes the advantageous effects described above.

According to preferred embodiments of the present invention, it is possible to provide internal combustion engines with each of which it is possible to significantly reduce or prevent a decrease in the fuel efficiency and an increase in the size of the variable valve mechanism, while surging is unlikely to occur while running at a high speed, and it is possible to reduce the size or the weight of the rocker arm, and a vehicle having the same.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
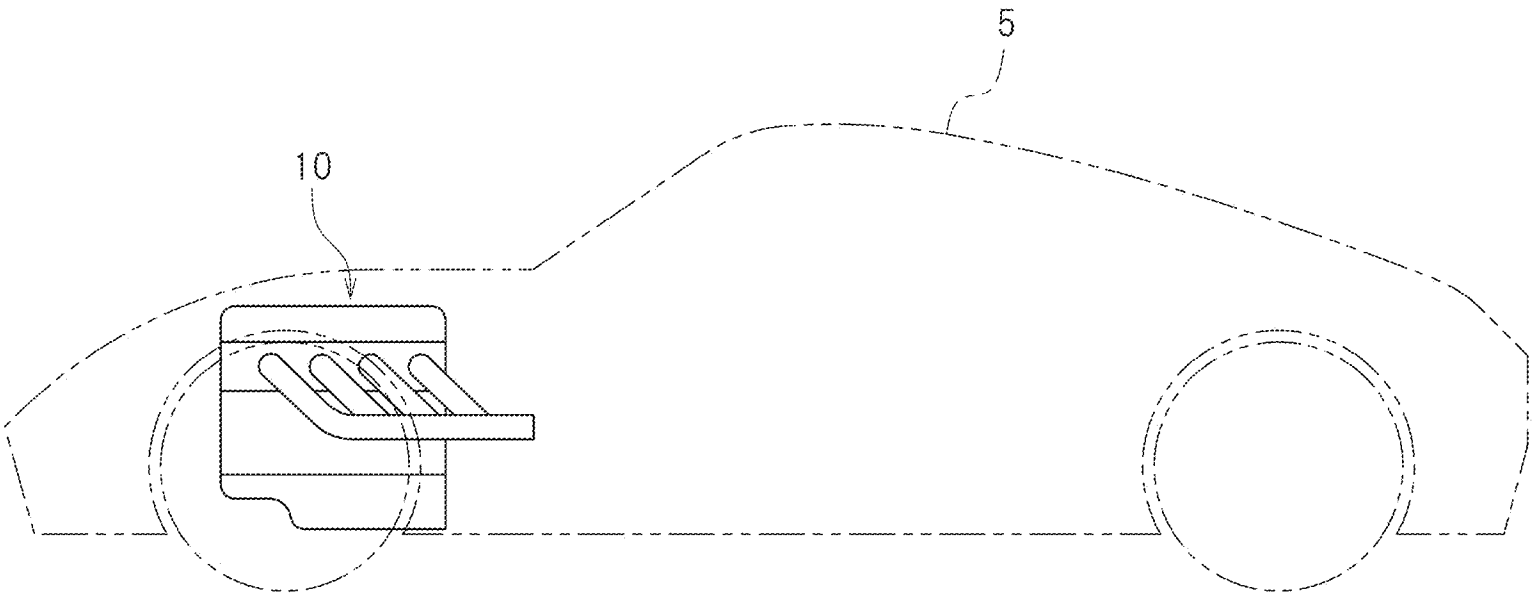
FIG. 1 is a view showing an example of an internal combustion engine according to a preferred embodiment of the present invention installed in an automobile.

Preferred embodiments of the present invention will now be described with reference to the drawings. An internal combustion engine according to the present preferred embodiment is installed in a vehicle and used as the drive source of the vehicle. There is no limitation on the type of the vehicle, which may be a straddled vehicle such as a motorcycle, an auto tricycle or an ATV (All Terrain Vehicle) or may be an automobile. For example, an internal combustion engine 10 may be provided in the engine room of an automobile 5 as shown in FIG. 1.

Figure 2:
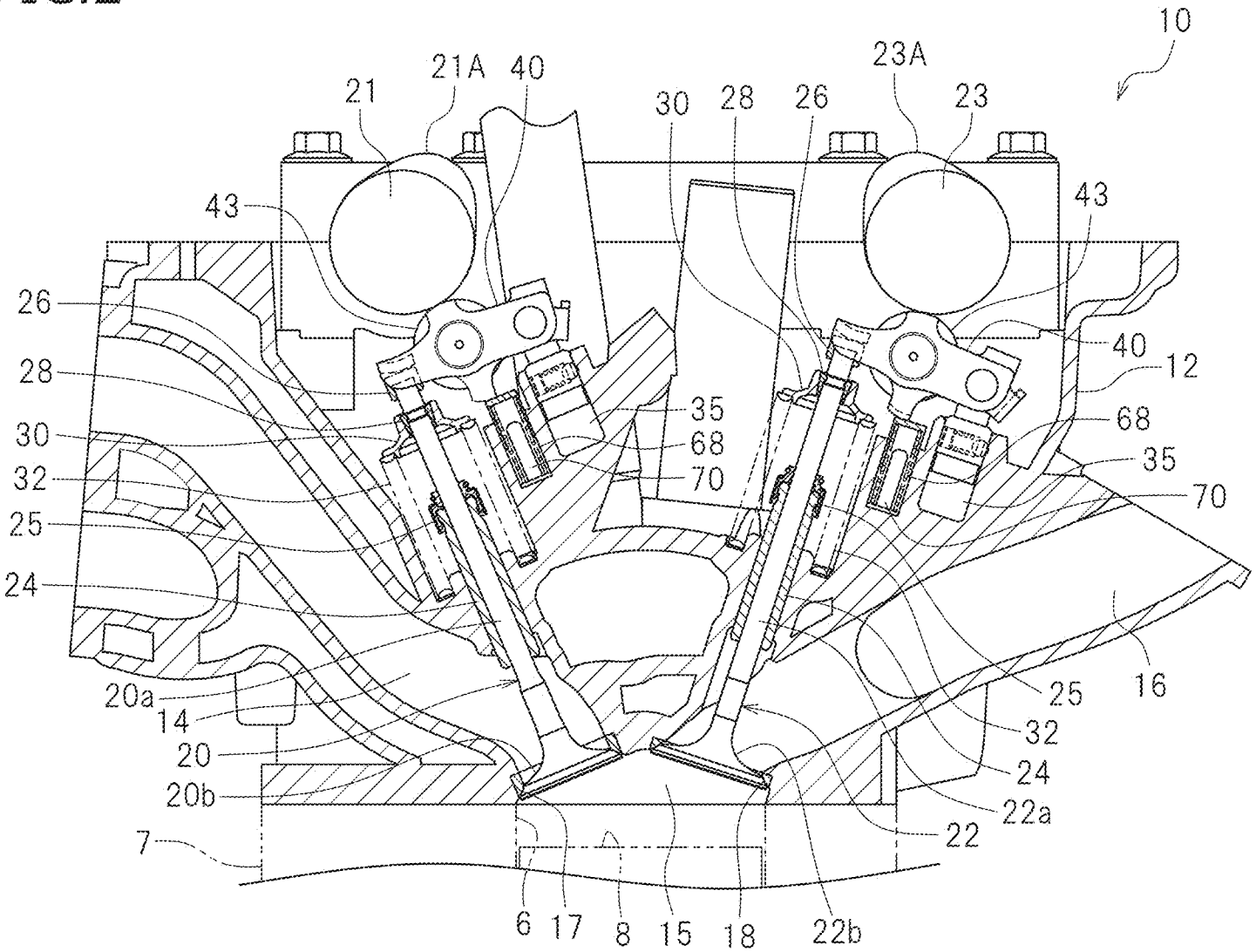
FIG. 2 is a partial cross-sectional view of the internal combustion engine.

The internal combustion engine 10 according to the present preferred embodiment is preferably a multi-cylinder engine including a plurality of cylinders. The internal combustion engine 10 is a 4-stroke engine that goes through the intake stroke, the compression stroke, the combustion stroke, and the exhaust stroke. FIG. 2 is a partial cross-sectional view of the internal combustion engine 10. As shown in FIG. 2, the internal combustion engine 10 includes a crankcase (not shown), a cylinder body 7 connected to the crankcase, and a cylinder head 12 connected to the cylinder body 7. A crankshaft (not shown) is located inside the crankcase. A plurality of cylinders 6 are provided inside the cylinder body 7. A piston 8 is located inside each cylinder 6. The piston 8 and the crankshaft are connected by a connecting rod (not shown).

An intake cam shaft 23 and an exhaust cam shaft 21 are rotatably supported on the cylinder head 12. Intake cams 23A are provided on the intake cam shaft 23, and exhaust cams 21A are provided on the exhaust cam shaft 21.

Intake ports 16 and exhaust ports 14 are provided in the cylinder head 12. An intake opening 18 is provided at one end of the intake port 16. An exhaust opening 17 is provided on one end of the exhaust port 14. The intake port 16 communicates with a combustion chamber 15 through the intake opening 18. The exhaust port 14 communicates with the combustion chamber 15 through the exhaust opening 17. The intake port 16 guides the mixed gas of the air and the fuel into the combustion chamber 15. The exhaust port 14 guides the exhaust gas discharged from the combustion chamber 15 to the outside.

Intake valves 22 and exhaust valves 20 are installed in the cylinder head 12. The intake valve 22 opens/closes the intake opening 18 of the intake port 16. The exhaust valve 20 opens/closes the exhaust opening 17 of the exhaust port 14. The intake valve 22 and the exhaust valve 20 are so-called poppet valves. The intake valve 22 includes a shaft portion 22*a* and an umbrella portion 22*b*, and the exhaust valve 20 includes a shaft portion 20*a* and an umbrella portion 20*b*. The configuration of the intake valve 22 and the configuration of the exhaust valve 20 are similar to each other, and the configuration of the intake valve 22 will be described below while omitting the description of the configuration of the exhaust valve 20. The shaft portion 22*a* of the intake valve 22 is slidably supported on the cylinder head 12 with a cylinder-shaped sleeve 24 therebetween. A valve stem seal 25 is attached to one end of the sleeve 24 and the shaft portion 22*a* of the intake valve 22. The shaft portion 22*a* of the intake valve 22 extends through the sleeve 24 and the valve stem seal 25. A tappet 26 is fitted to the tip of the shaft portion 22*a*.

Figure 3:
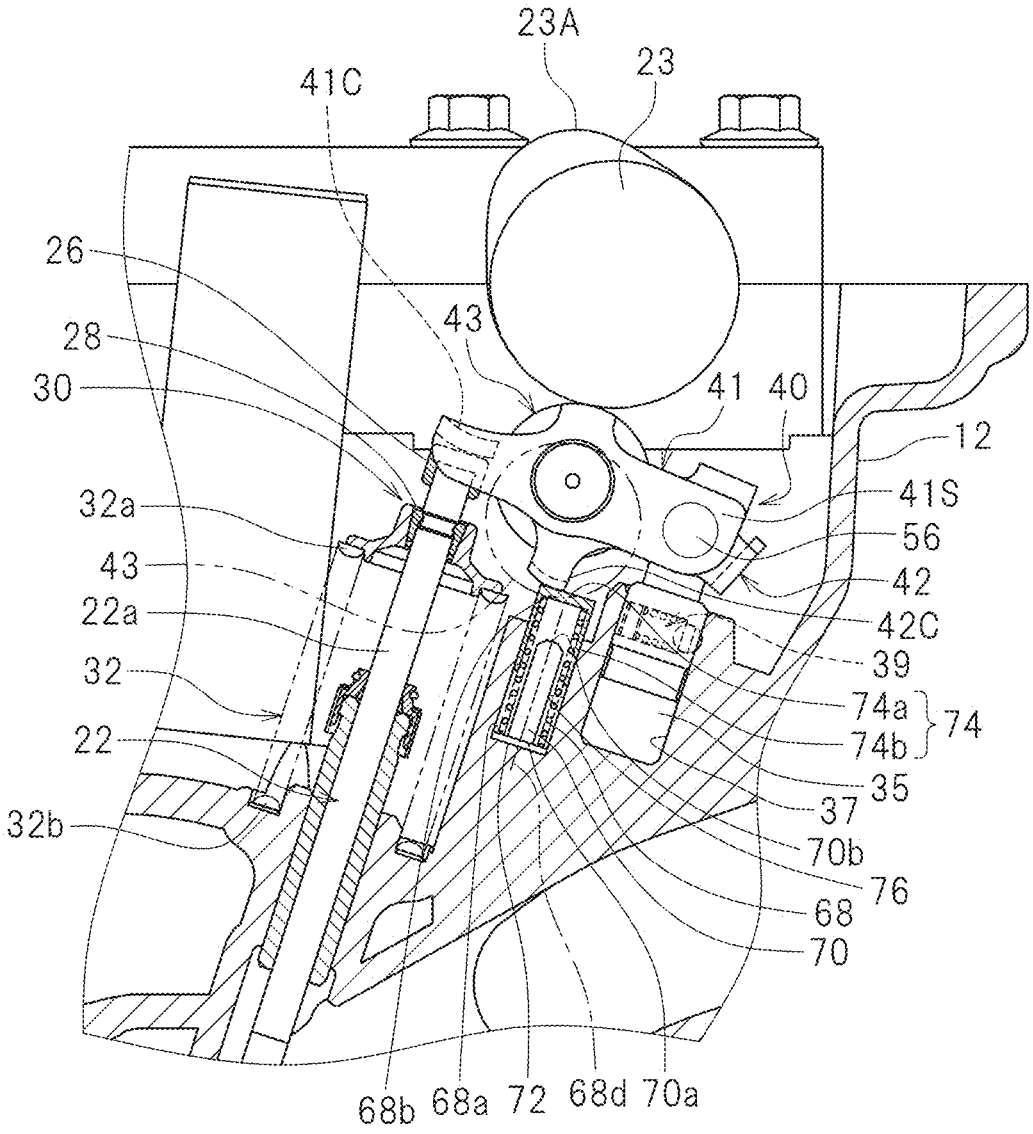
FIG. 3 is a partial enlarged cross-sectional view of the internal combustion engine.

As shown in FIG. 3, a cotter 28 is attached to the shaft portion 22*a* of the intake valve 22. The cotter 28 is fitted to a valve spring retainer 30. The valve spring retainer 30 is secured to the intake valve 22 with the cotter 28 therebetween. The valve spring retainer 30 is able to move, together with the intake valve 22, in an axial direction of the intake valve 22. The intake valve 22 extends through the valve spring retainer 30.

As shown in FIG. 3, the internal combustion engine 10 includes a valve spring 32 that provides the intake valve 22 with a force in the direction of closing the intake opening 18 (the upward direction in FIG. 3). The valve spring 32 is a compression coil spring, and includes a first spring end portion 32*b* supported on the cylinder head 12 and a second spring end portion 32*a* supported on the valve spring retainer 30.

Figure 4:
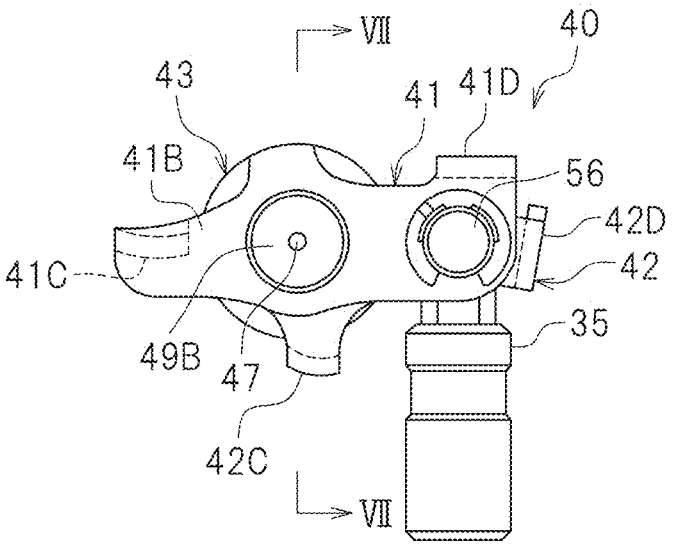
FIG. 4 is a side view of a rocker arm and a support member.
Figure 5:
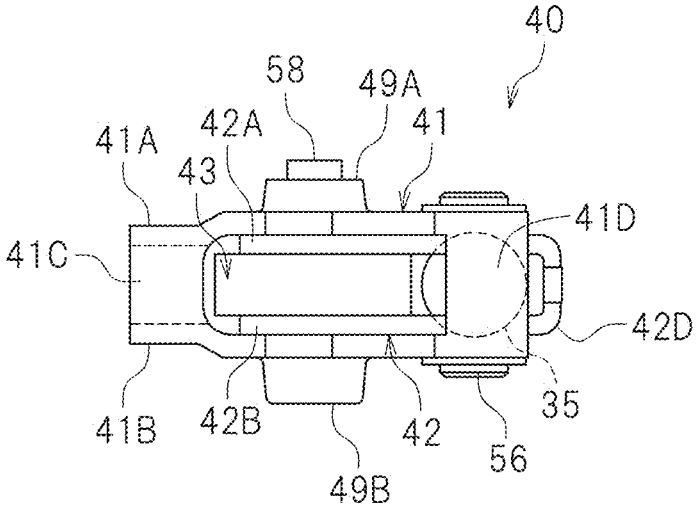
FIG. 5 is a plan view of the rocker arm and the support member.

The internal combustion engine 10 includes a rocker arm 40 that receives a force from the intake cam 23A to open/close the intake valve 22. The rocker arm 40 is pivotally supported on the cylinder head 12 with a support member 35 therebetween. FIG. 4 is a side view of the rocker arm 40 and the support member 35, and FIG. 5 is a plan view of the rocker arm 40 and the support member 35. The rocker arm 40 includes a first arm 41 and a second arm 42 including a roller 43.

Figure 6:
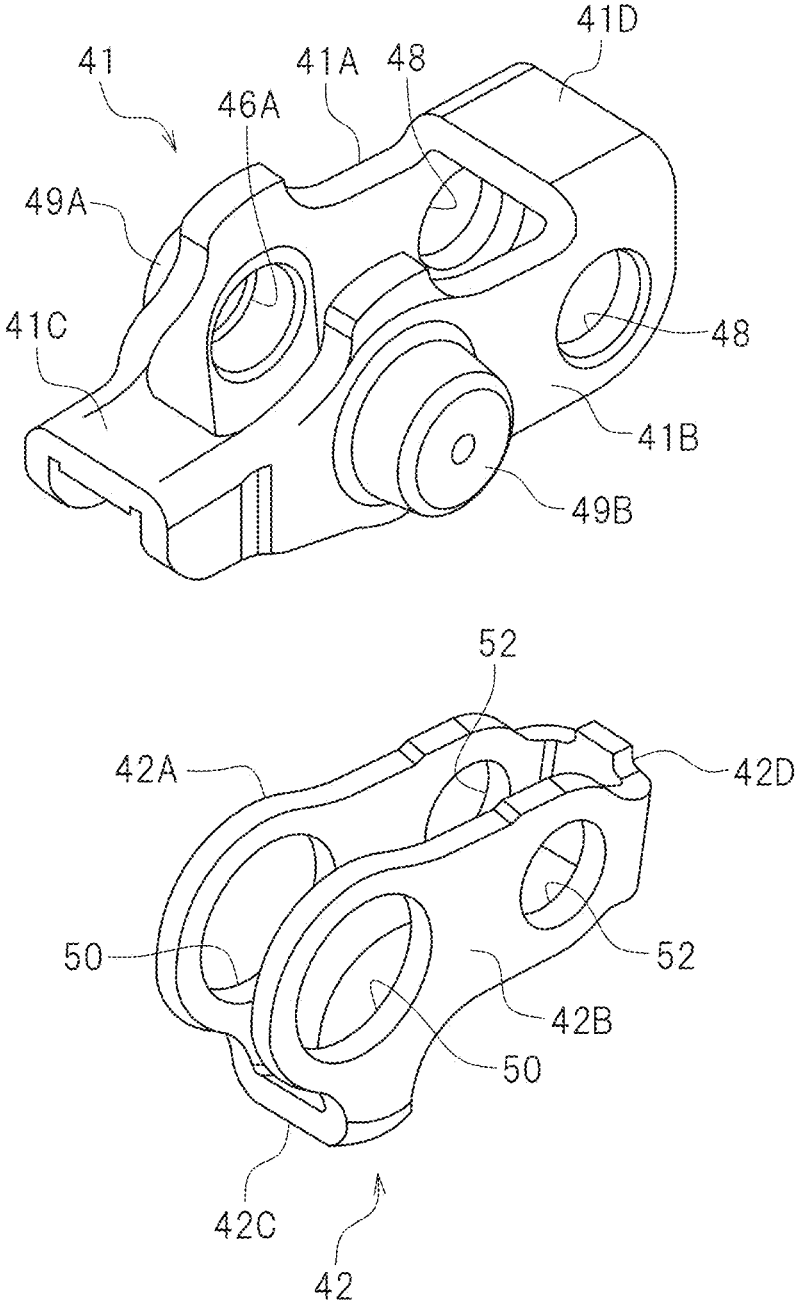
FIG. 6 is an exploded perspective view of a first arm and a second arm of the rocker arm.

FIG. 6 is an exploded perspective view of the first arm 41 and the second arm 42. The first arm 41 includes a plate 41A, a plate 41B, an abutting plate 41C, and a connecting plate 41D. The plate 41A and the plate 41B are parallel or substantially parallel to each other. The abutting plate 41C and the connecting plate 41D extend across the plate 41A and the plate 41B. The abutting plate 41C and the connecting plate 41D connect together the plate 41A and the plate 41B. The plate 41A includes a hole 46A and a hole 48. The plate 41B includes a hole 46B (see FIG. 7) and the hole 48. The holes 46A, 46B, and 48 extend in the direction parallel or substantially parallel to the axial line direction of the intake cam shaft 23 (see FIG. 3).

Figure 7:
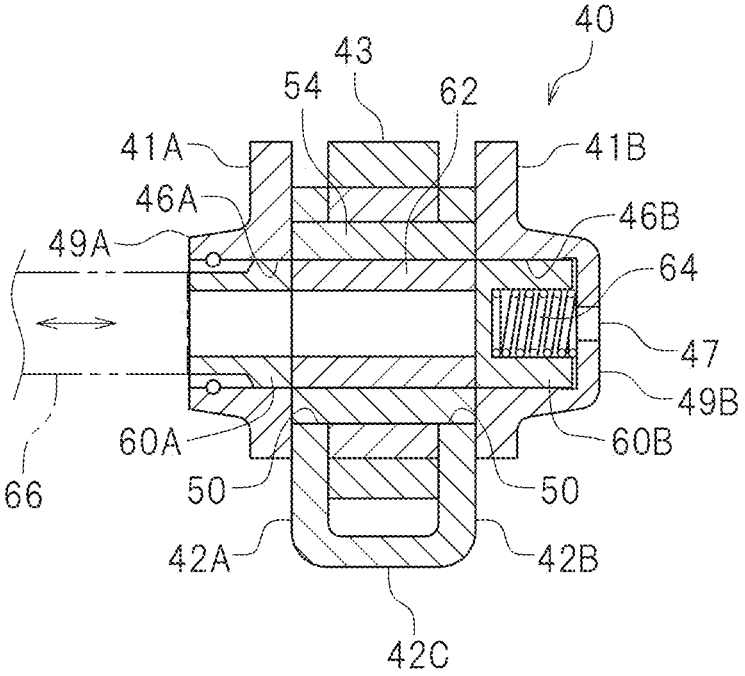
FIG. 7 is a cross-sectional view taken along line VII-VII of FIG. 4.

FIG. 7 is a cross-sectional view taken along line VII-VII of FIG. 4. As shown in FIG. 7, a cylinder-shaped boss portion 49A is provided around the hole 46A of the plate 41A. A connecting pin 60A is slidably inserted inside the hole 46A. A bottomed cylinder-shaped cover portion 49B is provided around the hole 46B of the plate 41B. The cover portion 49B is provided with a hole 47 having a smaller diameter than the hole 46B, but the hole 47 may be omitted. A connecting pin 60B is slidably inserted inside the hole 46B. A spring 64 is located inside the hole 46B. The spring 64 is present between the cover portion 49B and the connecting pin 60B, and urges the connecting pin 60B toward the plate 41A.

The second arm 42 is located on the inner side of the first arm 41. That is, the second arm 42 is located between the plate 41A and the plate 41B. As shown in FIG. 6 the second arm 42 includes a plate 42A, a plate 42B, an abutting plate 42C, and a connecting plate 42D. The plate 42A and the plate 42B are parallel or substantially parallel to each other. The abutting plate 42C and the connecting plate 42D extend across the plate 42A and the plate 42B. The abutting plate 42C and the connecting plate 42D connect together the plate 42A and the plate 42B. The plate 42A and the plate 42B include a hole 50 and a hole 52, respectively.

As shown in FIG. 7, the cylinder-shaped roller 43 is rotatably supported on the hole 50 of the plate 42A and the hole 50 of the plate 42B. Specifically, a cylinder-shaped collar 54 is inserted through the holes 50 of the plate 42A and the plate 42B. The roller 43 is rotatably supported on the collar 54. A connecting pin 62 is slidably inserted inside the collar 54. Since the collar 54 is located inside the holes 50, the connecting pin 62 is slidably inserted inside the holes 50. Note that the collar 54 is not always necessary. The connecting pin 62 may rotatably support the roller 43.

An outer diameter of the connecting pin 60B is less than or equal to an inner diameter of the collar 54. The connecting pin 60B is able to be inserted inside the collar 54. An outer diameter of the connecting pin 62 is less than or equal to an inner diameter of the hole 46A. The connecting pin 62 is able to be inserted inside the hole 46A. In the present preferred embodiment, the inner diameter of the collar 54 and the inner diameter of the hole 46A are equal to each other. The outer diameter of the connecting pin 60B, the outer diameter of the connecting pin 62 and an outer diameter of the connecting pin 60A are equal to each other.

As shown in FIG. 4, the support member 35, the first arm 41, and the second arm 42 are connected by a support pin 56. The support pin 56 is inserted through the hole 48 of the plate 41A and the hole 48 of the plate 41B of the first arm 41, and the hole 52 of the plate 42A and the hole 52 of the plate 42B of the second arm 42. The first arm 41 and the second arm 42 are pivotally supported on the support member 35 by the support pin 56. The second arm 42 is pivotally supported on the first arm 41 by the support pin 56.

As shown in FIG. 7, a connection switch pin 66 is located on the side of the rocker arm 40. The connection switch pin 66 is movable in the direction toward the connecting pin 60A and in the direction away from the connecting pin 60A.

Figure 8:
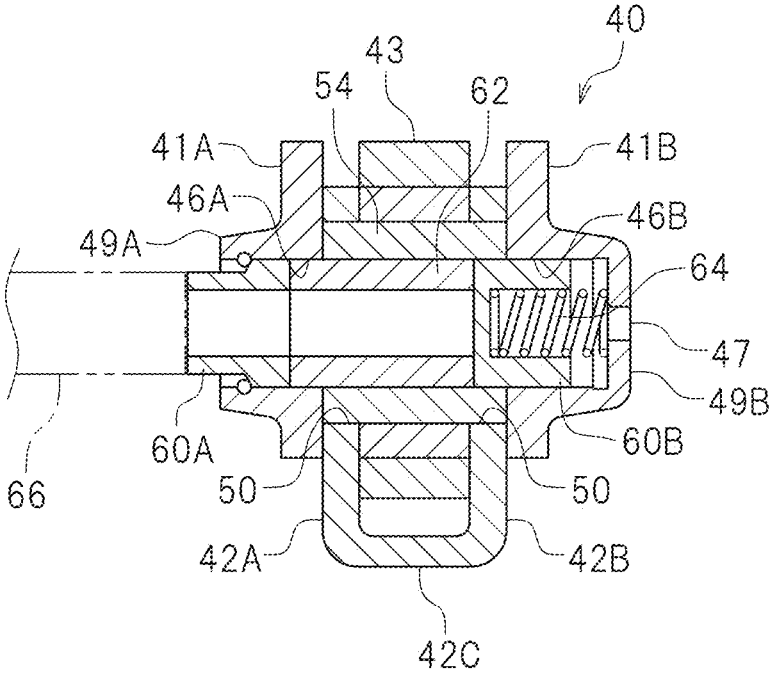
FIG. 8 is equivalent to FIG. 7, showing the rocker arm in the connected state.
Figure 9:
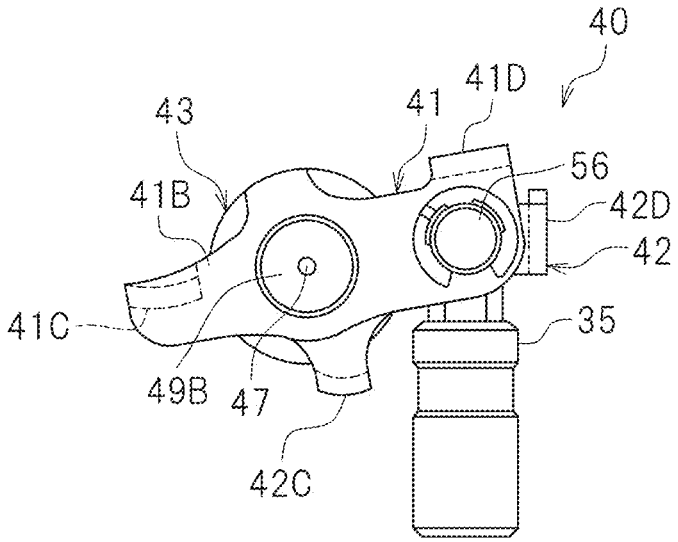
FIG. 9 is a side view showing the rocker arm in the connected state that has pivoted relative to the support member.

As shown in FIG. 8, when the connection switch pin 66 moves in the direction away from the connecting pin 60A, the connecting pins 60A, 62 and 60B slide leftward in FIG. 8 due to the force of the spring 64. Thus, the connecting pin 60B is located inside the hole 46B and inside the hole 50 (specifically, inside the collar 54), and the connecting pin 62 is located inside the hole 50 (specifically, inside the collar 54) and inside the hole 46A. This state will hereinafter be referred to as the connected state. In the connected state, the first arm 41 and the second arm 42 are connected together by the connecting pin 60B and the connecting pin 62. As a result, as shown in FIG. 9, the first arm 41 and the second arm 42 are, as a single unit, pivotable about an axis of the support pin 56.

Figure 10:
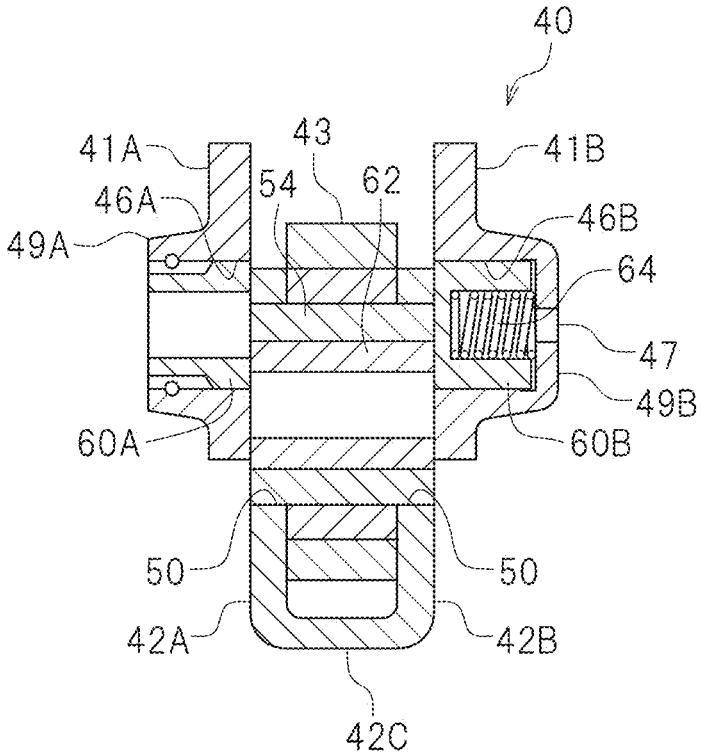
FIG. 10 is equivalent to FIG. 7, showing the rocker arm when the second arm pivots relative to the first arm.
Figure 11:
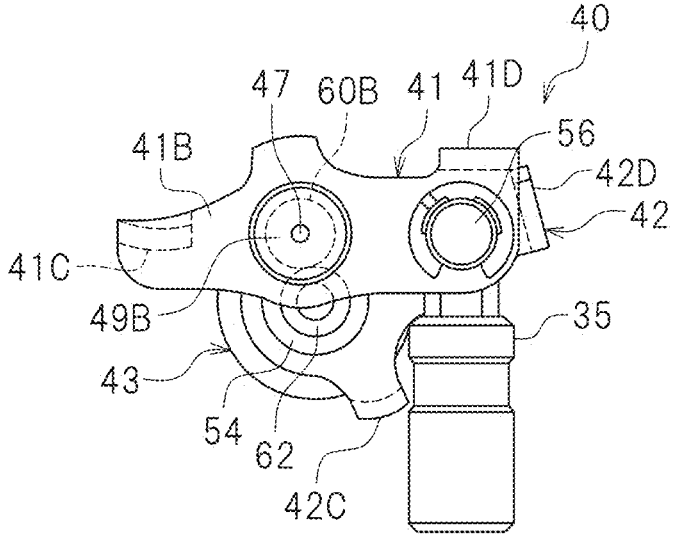
FIG. 11 is a side view showing the rocker arm and the support member when the second arm pivots relative to the first arm.

As shown in FIG. 7, the connection switch pin 66 moves toward the connecting pin 60A, the connecting pins 60A, 62, and 60B are pushed by the connection switch pin 66 and slide rightward in FIG. 7. Thus, the connecting pin 60B is located inside the hole 46B and not located inside the hole 50, and the connecting pin 62 is located inside the hole 50 and not located inside the hole 46A. This state will hereinafter be referred to as the non-connected state. In the non-connected state, as shown in FIG. 10, the connecting pin 62 is slidable relative to the connecting pin 60A and the connecting pin 60B. As a result, as shown in FIG. 11, the second arm 42 is pivotable about the axis of the support pin 56 relative to the first arm 41. Therefore, the second arm 42 pivots about the axis of the support pin 56 while the first arm 41 does not pivot.

As shown in FIG. 3, the portion of the first arm 41 that is supported by the support pin 56 (specifically, the portion of the plate 41A around the hole 48 and the portion of the plate 41B around the hole 48) defines a supported portion 41S that is pivotally supported on the cylinder head 12. The abutting plate 41C defines an abutting portion that abuts on the intake valve 22 with the tappet 26 therebetween.

As shown in FIG. 3, the internal combustion engine 10 includes a compression coil spring 68, as a lost motion spring, that urges the rocker arm 40 toward the intake cam 23A. Following the rotation of the intake cam shaft 23, the intake cam 23A alternates between the state in which the intake cam 23A presses the roller 43 of the rocker arm 40 and the state in which the intake cam 23A does not press the roller 43 of the rocker arm 40. When the roller 43 is pressed down, the second arm 42 pivots downward about the axis of the support pin 56. Then, the abutting plate 42C of the second arm 42 presses the compression coil spring 68 with the retainer 74 therebetween, thus compressing the compression coil spring 68. The second arm 42 is constantly receiving an upward force from the compression coil spring 68. In the state in which the intake cam 23A is not pressing the roller 43 downward, the compression coil spring 68 expands, and the second arm 42 pivots upward about the axis of the support pin 56 due to the force of the compression coil spring 68.

A shaft 70 that extends along a winding axis 68*d* of the compression coil spring 68 is located inside the compression coil spring 68. The shaft 70 includes a first shaft end portion 70*a*, and a second shaft end portion 70*b* that is located on the second arm 42 side relative to the first shaft end portion 70*a*.

A spring seat 72 that receives the compression coil spring 68 is provided at the first shaft end portion 70*a*. The spring seat 72 may be secured to the shaft 70, and the spring seat 72 and the shaft 70 may be integral together.

The compression coil spring 68 includes a first end portion 68*a*, and a second end portion 68*b* that is located on the second arm 42 side relative to the first end portion 68*a*. A retainer 74 is supported at the second end portion 68*b*. The retainer 74 includes a disc-shaped top plate portion 74*a* and a cylinder-shaped tube portion 74*b*. The tube portion 74*b* extends from the top plate portion 74*a* along an axial direction of the shaft 70 toward the compression coil spring 68. The top plate portion 74*a* is supported on the second end portion 68*b* of the compression coil spring 68. The top plate portion 74*a* is in contact with the abutting plate 42C of the second arm 42 of the rocker arm 40. The abutting plate 42C of the second arm 42 defines a spring force receiver that receives the force of the compression coil spring 68 with the retainer 74 therebetween.

The cylinder head 12 includes a hole 76. The spring seat 72, at least a portion of the shaft 70, at least a portion of the compression coil spring 68, and at least a portion of the tube portion 74*b* of the retainer 74 are located inside the hole 76.

As shown in FIG. 3, when the first arm 41 and the second arm 42 of the rocker arm 40 are connected together by the connecting pins 60B, 62, and the intake valve 22 is closed, a portion of the tube portion 74*b* of the retainer 74 is located on the second shaft end portion 70*b* side relative to the first shaft end portion 70*a* of the shaft 70 and on the first shaft end portion 70*a* side relative to the second shaft end portion 70*b*.

The intake valve 22, the valve spring 32, the shaft 70, the retainer 74, the compression coil spring 68, and the support member 35 are parallel or substantially parallel to each other. The retainer 74 is located between the valve spring 32 and the support member 35. The shaft 70 is located between the valve spring 32 and the support member 35.

Figure 12:
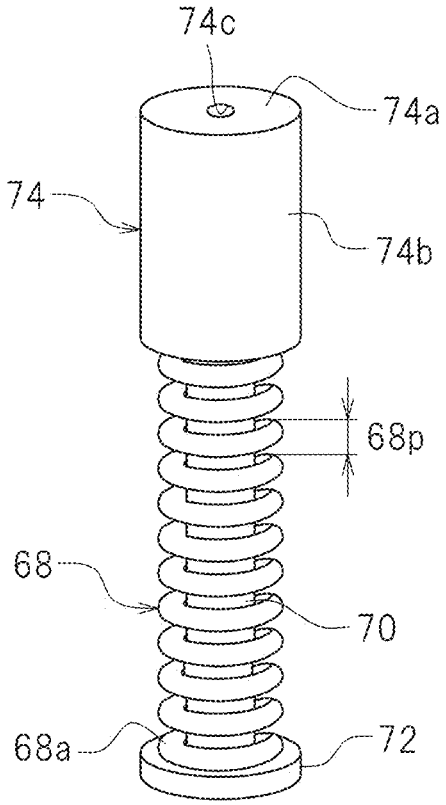
FIG. 12 is a perspective view of a retainer, a compression coil spring, a shaft, and a spring seat.

FIG. 12 is a perspective view of the retainer 74, the shaft 70, the compression coil spring 68, and the spring seat 72. As shown in FIG. 12, a through opening 74*c* is provided in the top plate portion 74*a* of the retainer 74. As described above, at least a portion of the tube portion 74*b* of the retainer 74 is located inside the hole 76 of the cylinder head 12 (see FIG. 3). The hole 76 is covered by the retainer 74. When the through opening 74*c* is not provided in the top plate portion 74*a*, the air pressure inside the hole 76 fluctuates following the up-down movement of the retainer 74, and movement of the retainer 74 may possibly be hindered. However, when the through opening 74*c* is provided in the top plate portion 74*a*, the inside and the outside of the hole 76 communicate with each other through the through opening 74*c*. Therefore, the air moves between the inside and the outside of the hole 76. This reduces the fluctuation of the air pressure inside the hole 76. Thus, the movement of the retainer 74 is smooth.

Figure 13:
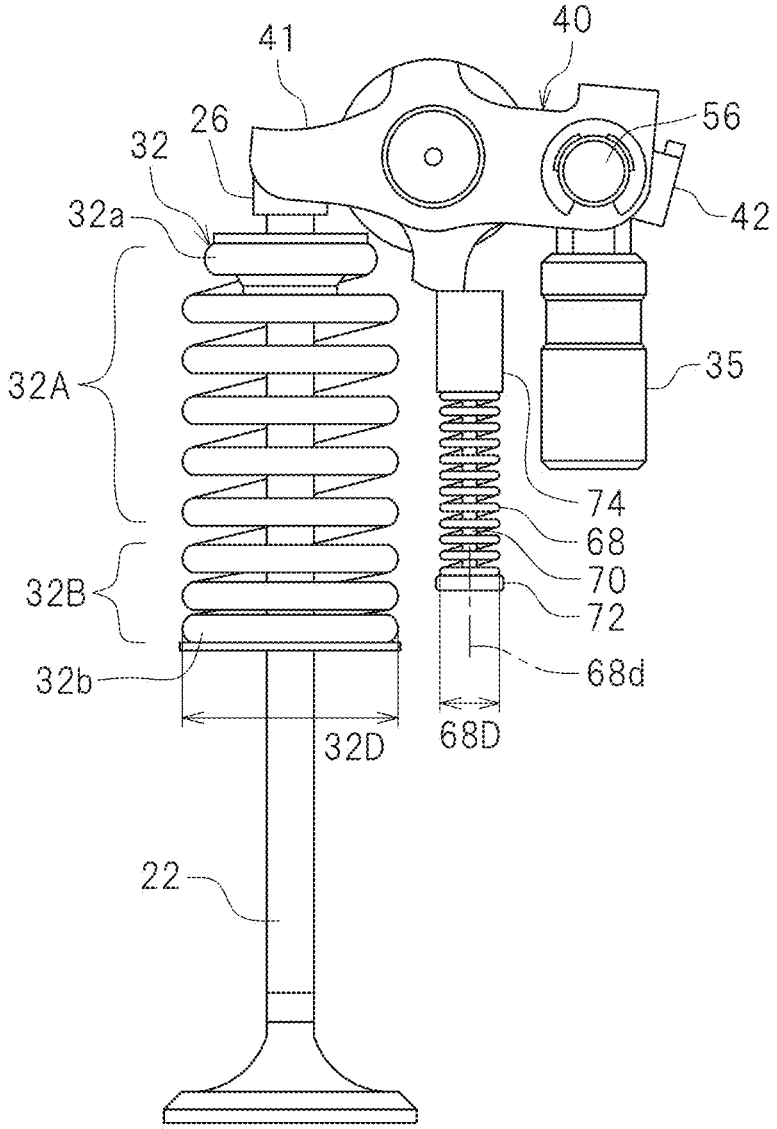
FIG. 13 is a side view of a variable valve mechanism.

In the present preferred embodiment, the compression coil spring 68 has a constant pitch 68*p*. On the other hand, as shown in FIG. 13, the valve spring 32 includes a non-constant pitch section 32B in which the pitch is not constant and a constant pitch section 32A in which the pitch is constant, the non-constant pitch section 32B extending from the first spring end portion 32*b* toward the second spring end portion 32*a*, and the constant pitch section 32A extending from the non-constant pitch section 32B toward the second spring end portion 32*a*. The compression coil spring 68 and the valve spring 32 have different dimensions. The length of the compression coil spring 68 is shorter than the length of the valve spring 32. A winding diameter 68D of the compression coil spring 68 is smaller than a winding diameter 32D of the valve spring 32. As shown in FIG. 13, the first arm 41 and the second arm 42 of the rocker arm 40 are connected together by the connecting pins 60B, 62, and when the intake valve 22 is closed, a portion of the compression coil spring 68 is located on the non-constant pitch section 32B side relative to the constant pitch section 32A, and another portion of the compression coil spring 68 is located on the constant pitch section 32A side relative to the non-constant pitch section 32B. The compression coil spring 68 is next to a portion of the constant pitch section 32A and a portion of the non-constant pitch section 32B.

As shown in FIG. 2, as with the intake valve 22, the valve spring 32, the valve spring retainer 30, the rocker arm 40, the support member 35, the compression coil spring 68, the shaft 70, etc., are provided also for the exhaust valve 20. These elements are similar to those described above, and will not be described in detail below.

With the internal combustion engine 10 according to the present preferred embodiment, it is possible to switch the operation state of the intake valve 22 and the exhaust valve 20 by switching the state of the connection switch pin 66.

That is, when the connection switch pin 66 is switched to the connected state, the first arm 41 and the second arm 42 of the rocker arm 40 are connected together by the connecting pin 60B and the connecting pin 62 (see FIG. 8). When the intake cam 23A pushes the roller 43 of the rocker arm 40 following the rotation of the intake cam shaft 23, the first arm 41 and the second arm 42, as a single unit, pivot about the axis of the support pin 56 (see FIG. 9). As a result, the abutting plate 41C of the first arm 41 pushes the intake valve 22, thus opening the intake opening 18 of the intake port 16. Similarly, when the exhaust cam 21A pushes the roller 43 of the rocker arm 40 following the rotation of the exhaust cam shaft 21, the first arm 41 and the second arm 42, as a single unit, pivot about the axis of the support pin 56. As a result, the abutting plate 41C of the first arm 41 pushes the exhaust valve 20, thus opening the exhaust opening 17 of the exhaust port 14.

When the connection switch pin 66 is switched to the non-connected state, the connection between the first arm 41 and the second arm 42 by the connecting pin 60B and the connecting pin 62 is disconnected (see FIG. 7). The second arm 42 becomes pivotable relative to the first arm 41 (see FIG. 10). When the intake cam 23A pushes the roller 43 following the rotation of the intake cam shaft 23, the second arm 42 pivots about the axis of the support pin 56 while the first arm 41 does not pivot (see FIG. 11). Therefore, the abutting plate 41C of the first arm 41 will not push the intake valve 22, and the intake opening 18 remains closed by the intake valve 22. Similarly, when the exhaust cam 21A pushes the roller 43 following the rotation of the exhaust cam shaft 21, the second arm 42 pivots about the axis of the support pin 56 while the first arm 41 does not pivot. Therefore, the abutting plate 41C of the first arm 41 will not push the exhaust valve 20, and the exhaust opening 17 remains closed by the exhaust valve 20. Thus, in the present preferred embodiment, one or more of a plurality of cylinders are able to be brought into the inoperative state by switching the connection switch pin 66 to the non-connected state. For example, by making one or more cylinders inoperative while the load is small, it is possible to improve the fuel efficiency.

The internal combustion engine 10 according to the present preferred embodiment, as described above, includes, as a lost motion spring, the compression coil spring 68 separate from the rocker arm 40. Since there is no need to attach a torsion coil spring to the rocker arm 40, it is possible to reduce the size and the weight of the rocker arm 40.

The compression coil spring 68 according to the present preferred embodiment is a coil spring that is relatively thin. The winding diameter 68D of the compression coil spring 68 is smaller than the winding diameter 32D of the valve spring 32. Therefore, it is possible to easily avoid interference between the compression coil spring 68 and other members in the vicinity thereof (e.g., the valve spring retainer 30, the valve spring 32, the support member 35, etc.).

The compression coil spring 68 according to the present preferred embodiment is a coil spring that is relatively long. As shown in FIG. 13, when the first arm 41 and the second arm 42 of the rocker arm 40 are connected together and the valve 20, 22 is closed, a portion of the compression coil spring 68 is located on the non-constant pitch section 32B side relative to the constant pitch section 32A of the valve spring 32, and another portion of the compression coil spring 68 is located on the constant pitch section 32A side relative to the non-constant pitch section 32B. The compression coil spring 68 extends from the constant pitch section 32A to the non-constant pitch section 32B of the valve spring 32 in the winding direction of the valve spring 32. Thus, since the compression coil spring 68 is relatively long, it is possible to output an intended force in a stable manner even if the winding diameter 68D is relatively small.

Although the compression coil spring 68 is a coil spring that is thin and long according to the present preferred embodiment, the shaft 70 restricts bending of the compression coil spring 68, and the compression coil spring 68 is unlikely to bend relative to the winding axis 68*d*. Therefore, the compression coil spring 68 outputs an intended force in a stable manner, and the timing with which to open/close the valve 20, 22 is unlikely to shift. Thus, the switchable range of the operation state of the valve 20, 22 will not be narrowed, thus significantly reducing or preventing a decrease in the fuel efficiency of the internal combustion engine 10.

Since the compression coil spring 68 is unlikely to bend relative to the winding axis 68*d*, the compression coil spring 68 is unlikely to interfere with other members in the vicinity thereof. Therefore, there is no need to increase the clearance between the compression coil spring 68 and other members in the vicinity thereof (e.g., the valve spring retainer 30, the valve spring 32, the support member 35, etc.), and it is possible to significantly reduce or prevent an increase in the size of the variable valve mechanism.

Now, the compression coil spring 68 that is thin and long is likely to cause surging when the compression coil spring 68 repeatedly expands/contracts many times within a short amount of time. Therefore, surging is likely to occur while the internal combustion engine 10 is running at a high speed. However, with the internal combustion engine 10 according to the present preferred embodiment, the compression coil spring 68 is able to come into contact with the shaft 70, and when surging is about to occur while the internal combustion engine 10 is running at a high speed, the compression coil spring 68 and the shaft 70 come into contact with each other, thus attenuating the surging. Thus, surging is unlikely to occur while running at a high speed.

Therefore, with the internal combustion engine 10 according to the present preferred embodiment, it is possible to significantly reduce or prevent a decrease in the fuel efficiency and an increase in the size of the variable valve mechanism, while surging is unlikely to occur while running at a high speed, and it is possible to reduce the size and the weight of the rocker arm 40.

Although the spring seat 72 is not always necessary, the spring seat 72 that receives the compression coil spring 68 is provided at the first shaft end portion 70*a* of the shaft 70 in the present preferred embodiment. This makes the installment of the compression coil spring 68 in the cylinder head 12 easy. Since the spring seat 72 is installed together with the shaft 70 when the shaft 70 is installed in the hole 76, it is possible to prevent the installment of the spring seat 72 from being forgotten.

According to the present preferred embodiment, the retainer 74 includes the top plate portion 74*a* and the tube portion 74*b*. Therefore, it is possible with the tube portion 74*b* to further restrict bending of the compression coil spring 68. Thus, the compression coil spring 68 outputs an intended force in a stable manner.

According to the present preferred embodiment, when the first arm 41 and the second arm 42 of the rocker arm 40 are connected together and the valve 20, 22 is closed, a portion of the tube portion 74*b* of the retainer 74 is located on the second shaft end portion 70*b* side relative to the first shaft end portion 70*a* of the shaft 70 and on the first shaft end portion 70*a* side relative to the second shaft end portion 70*b* (see FIG. 3). On a predetermined cross section that is perpendicular or substantially perpendicular to a winding axis 60*d*, the compression coil spring 68 is located between the shaft 70 and the tube portion 74*b*. Thus, according to the present preferred embodiment, the tube portion 74*b* of the retainer 74 is elongated. A portion of the compression coil spring 68 is located radially outward of the shaft 70 and is located radially inward of the tube portion 74*b*. Therefore, since the shaft 70 and the tube portion 74*b* both restrict bending of the compression coil spring 68, it is possible to further restrict bending of the compression coil spring 68.

According to the present preferred embodiment, the hole 76 is provided in the cylinder head 12, at least a portion of the compression coil spring 68, at least a portion of the shaft 70, and at least a portion of the retainer 74 are located inside the hole 76. According to the present preferred embodiment, the compression coil spring 68, the shaft 70, and the retainer 74 are securely installed in the cylinder head 12. It is possible with the inner circumferential surface of the hole 76 to further restrict bending of the compression coil spring 68.

When at least a portion of the compression coil spring 68, at least a portion of the shaft 70, and at least a portion of the retainer 74 are located inside the hole 76 as in the present preferred embodiment, the movement of the retainer 74 may possibly be hindered by the fluctuation of the air pressure inside the hole 76. In the present preferred embodiment, however, the through opening 74*c* is provided in the top plate portion 74*a* of the retainer 74 as shown in FIG. 12. The air can move between the inside and the outside of the hole 76 through the through opening 74*c*. This reduces the fluctuation of the air pressure inside the hole 76, thus smoothing the movement of the retainer 74.

While the pitch 68*p* of the compression coil spring 68 is not needed to be constant, it is constant in the present preferred embodiment. Where the compression coil spring includes a constant pitch section and a non-constant pitch section, the constant pitch section contracts while the non-constant pitch section does not substantially contract, unless the external force acting upon the compression coil spring is excessively large. In such a case, the non-constant pitch section does not substantially exert an elastic force. Therefore, where a first compression coil spring having a constant pitch and a second compression coil spring that includes a constant pitch section and a non-constant pitch section are equal in length, the first compression coil spring has a longer portion that outputs an elastic force and the first compression coil spring is able to therefore output a larger elastic force, unless the external force is excessively large. Conversely, when the first compression coil spring and the second compression coil spring output an equal elastic force, the first compression coil spring is able to be shorter than the second compression coil spring. Therefore, the compression coil spring 68 having a constant pitch is made more compact than a compression coil spring with a pitch that is not constant.

On the other hand, with the compression coil spring 68 having a constant pitch, surging is more likely to occur as compared with a compression coil spring with a pitch that is not constant. However, in the present preferred embodiment, the shaft 70 significantly reduces or prevents the surging of the compression coil spring 68, as described above. Therefore, the compression coil spring 68 having a constant pitch is able to be used with no problems. The advantageous effect of significantly reducing or preventing the surging of the compression coil spring 68 by the contact between the compression coil spring 68 and the shaft 70 is more pronounced.

While preferred embodiments of the present invention have been described above, it is needless to say that the present invention is not limited to the above-described preferred embodiments. Next, examples of alternative preferred embodiments will be briefly described.

In the preferred embodiments described above, the first arm 41 is not to be in contact with the cam 21A, 23A. In the preferred embodiments described above, the valve 20, 22 is brought to the inoperative state by switching the first arm 41 and the second arm 42 of the rocker arm 40 to the non-connected state. However, the first arm 41 may include a contact portion that contacts with the cam 21A, 23A after the second arm 42 starts pivoting as the roller 43 is pushed by the cam 21A, 23A. In such a case, it is possible to change the timing with which the valve 20, 22 is opened and closed by switching the first arm 41 and the second arm 42 to the non-connected state. Thus, it is possible to change the period in which the valve 20, 22 is open. For example, by extending the period in which the valve 20, 22 is open when the speed of the internal combustion engine 10 is high, it is possible to improve the performance at a high engine speed.

In the preferred embodiments described above, the internal combustion engine 10 is preferably a multi-cylinder engine. However, the internal combustion engine 10 may be a single-cylinder engine with which it is possible to change the timing with which the valve 20, 22 is opened/closed.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An internal combustion engine comprising:

a cylinder head;

a port in the cylinder head;

a valve in the cylinder head to open/close the port;

a cam shaft rotatably supported on the cylinder head;

a cam provided on the cam shaft;

a compression coil spring supported on the cylinder head;

a rocker arm including a first arm and a second arm, the first arm including a supported portion pivotally supported on the cylinder head and an abutting portion that abuts on the valve, the second arm including a contact portion that contacts with the cam and a spring force receiver that receives a force of the compression coil spring, the second arm being pivotally supported on the first arm;

a connector that removably connects the first arm and the second arm;

a shaft located on an inner side of the compression coil spring and that extends along a winding axis of the compression coil spring;

a valve spring retainer secured to the valve; and a valve spring defining a second compression coil spring and that includes a first spring end portion supported on the cylinder head and a second spring end portion supported on the valve spring retainer; wherein a winding diameter of the compression coil spring is smaller than a winding diameter of the valve spring;

the valve spring includes a non-constant pitch section in which a pitch of the valve spring is not constant and a constant pitch section in which the pitch of the valve spring is constant, the non-constant pitch section extends from the first spring end portion toward the second spring end portion, and the constant pitch section extends from the non-constant pitch section toward the second spring end portion; and when the first arm and the second arm are connected by the connector and the valve is closed, a portion of the compression coil spring is located on a side of the non-constant pitch section relative to the constant pitch section, and another portion of the compression coil spring is located on a side of the constant pitch section relative to the non-constant pitch section.

2. The internal combustion engine according to claim 1, wherein the shaft includes a first shaft end portion, and a second shaft end portion located on a side of the second arm relative to the first shaft end portion; and the internal combustion engine further includes a spring seat that is provided at the first shaft end portion of the shaft and receives the compression coil spring.

3. The internal combustion engine according to claim 2, wherein the compression coil spring includes a first end portion, and a second end portion located on a side of the second arm relative to the first end portion; and the internal combustion engine further includes a retainer including a top plate portion and a tube portion, the top plate portion is supported on the second end portion of the compression coil spring and is in contact with the spring force receiver of the second arm, and the tube portion extends from the top plate portion toward the compression coil spring along an axial direction of the shaft.

4. The internal combustion engine according to claim 3, wherein, when the first arm and the second arm are connected by the connector and the valve is closed, a portion of the tube portion of the retainer is located on a side of the second shaft end portion relative to the first shaft end portion and on a side of the first shaft end portion relative to the second shaft end portion.

5. The internal combustion engine according to claim 3, wherein the cylinder head includes a hole; and at least a portion of the compression coil spring, at least a portion of the shaft, and at least a portion of the retainer are located inside the hole.

6. The internal combustion engine according to claim 5, wherein the top plate portion includes a through opening.

7. The internal combustion engine according to claim 1, wherein the cylinder head includes a hole; and at least a portion of the compression coil spring and at least a portion of the shaft are located inside the hole.

8. The internal combustion engine according to claim 1, wherein a pitch of the compression coil spring is constant.

9. A vehicle comprising the internal combustion engine according to claim 1.

* * * * *